US007204002B2

(12) United States Patent
Kaneko et al.

(10) Patent No.: US 7,204,002 B2
(45) Date of Patent: Apr. 17, 2007

(54) BUCKLE AND BABY CARRIER USING THE SAME

(75) Inventors: Hitoshi Kaneko, Saitama (JP); Sakiko Minami, Saitama (JP); Yuko Moriguchi, Saitama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/116,974

(22) Filed: Apr. 28, 2005

(65) Prior Publication Data

US 2005/0241122 A1 Nov. 3, 2005

(30) Foreign Application Priority Data

Apr. 30, 2004 (JP) ..... 2004-136685

(51) Int. Cl.
*A44B 11/25* (2006.01)

(52) U.S. Cl. ..... 24/614; 24/615; 24/644; 24/701; 24/702; 24/697; 24/697.1; 24/666

(58) Field of Classification Search ..... 24/614, 24/615, 701, 702, 697.1, 669, 616, 666, 667, 24/DIG. 52, 644; 40/85, 448; *A44B 11/25*
See application file for complete search history.

(56) References Cited

U.S. PATENT DOCUMENTS 3,484,907 A * 12/1969 Elsenheimer ..... 24/588.12
5,440,792 A * 8/1995 Ida ..... 24/615
5,774,957 A * 7/1998 Kohl et al. ..... 24/701
6,357,092 B1 * 3/2002 Burrows ..... 24/644

FOREIGN PATENT DOCUMENTS

| | | |
|---|---|---|
| EP | 0704183 | 4/1996 |
| JP | 2004-000687 | 1/2004 |
| JP | 2004000687 A * | 1/2004 |
| WO | WO 03/003869 | 1/2003 |

* cited by examiner

*Primary Examiner*—J J Swann
*Assistant Examiner*—Marcus Menezes
(74) *Attorney, Agent, or Firm*—Everest Intellectual Property Law Group; Michael S. Leonard

(57) ABSTRACT

A buckle including a pair of members (4, 5) coupled to or separated from each other. The buckle includes a socket (10) and a plug (30) capable of being inserted into the socket and hooked in the socket in the state where the plug is inserted into a prespecified position. The socket is attached to a one member (5) in the pair. The plug has a pull section (33) in the direction intersectional to the plug inserting direction, and a mounting section (37) with the other member mounted thereon is provided on the pull section (33).

15 Claims, 14 Drawing Sheets

BUCKLE AND BABY CARRIER USING THE SAME

BACKGROUND OF THE INVENTION

1. Field of the Invention

The present invention relates to a buckle and a baby carrier using the buckle. More specifically the present invention relates to a buckle for coupling or separating a pair of members and a baby carrier using the buckle.

2. Description of Related Art

There has been known a buckle having a socket and a plug capable of being inserted into the socket and hooked in the socket in the state where the plug is inserted into a prespecified position in the socket as a unit for coupling or separating a pair of members to or from each other.

With the buckle having the configuration as described above, a pair of members can be coupled to or separated from each other with a relatively simple operation, so that the buckle is widely used for coupling or separating a belt, a tape, a string, and the like.

For instance, Japanese Patent Laid-Open Publication No. 2004-687 discloses the possibility of forming a bag-like carrier as a baby carrier by attaching one side of a buckle (for instance, a plug) to a tip of a belt member provided in a back member and also attaching the other side of the buckle (for instance, a socket) to a shoulder belt and engaging the two members with each other.

With the baby carrier having the configuration described above, a user can assemble the baby carrier just by engaging the plug of the buckle with the socket of the same, and can disassemble the carrier by unhooking the plug of the buckle from the socket of the same, so that the user can handle the baby carrier with a extremely simple operation.

However with the conventional buckle, a plug and a socket are attached to tips of a belt member at which the members are coupled to and separated from each other, and a user holds a back end of the socket and makes a front end of the plug inserted to and engaged with the socket or pulled out from the socket, which causes the problem that it can be difficult for a user in a wrong position to insert or pull out the plug.

In a buckle used in a baby carrier, a socket of this type of buckle is attached to a shoulder belt that a user wears it on the user's shoulder, so that it is extremely difficult for the user to hold and insert a back end of a plug to the socket or pull out the plug therefrom.

SUMMARY OF THE INVENTION

An object of the present invention is to provide a buckle and a baby carrier which allows for easy operations for inserting and pulling out a plug.

A buckle according to the present invention for coupling or separating a pair of members includes a socket and a plug capable of being inserted into the socket and hooked in the socket in the state where the plug is inserted to a prespecified position, and in which the socket is attached to a one member of the pair of members; the plug has a pull section in the direction intersectional to the inserting direction of the plug, and the pull section has an mounting section with the other member mounted thereon.

With the configuration as described above, when a user inserts the plug into the socket in the state where the socket is attached to the one of members and the mounting section of the plug is attached to the other one of members, the user holds the pull section of the plug and inserts the plug to the socket. The plug inserted to the prespecified position is hooked in the socket. It means that two members are coupled to each other, and the plug is hooked in the socket. On the other hand, in order to pull out the plug from the socket, the user holds the pull section of the plug and pulls out the plug from the socket, and then the plug is unhooked from the socket. The two members are separated from each other.

Because the user can insert and pull out the plug by holding the pull section of the plug, the user can easily insert and pull out the plug as compared to the conventional type one where the user holds a back end of a plug and inserts or pulls out the plug. In particular, the pull section is provided in a direction intersectional to the plug inserting direction, so that the user can easily hold the pull section and slide (insert or pull out) the plug.

With the buckle of the present invention it is preferable that the socket is attached to the one member so that the inserting direction of the plug crosses the direction in which the other member receives a tensile force.

There is the problem in the conventional type of buckle that, as this type of buckle has the configuration in which the plug and the socket are attached to the tip of belt members at which the members are coupled to and separated from each other, and the plug and the socket are inserted into and hooked in along the longitudinal direction of the belt members, when the belt members receives a relatively large tensile force in the longitudinal direction, it is likely for the socket and the plug of the buckle to be unhooked from each other.

With the buckle of the present invention, when either one of the members (for example, the other one of the members) receives a relatively large tensile force in a state where the plug is hooked in the socket, as the tensile force acts in the direction orthogonal to the plug inserting direction, the tensile force is divided to two components, a component along the plug inserting direction, and a component orthogonal to the plug inserting direction. Therefore strength of the force in the plug inserting direction decreases in proportion, and then the buckle keeps hooked under the relatively large tensile force. As a result the buckle is hooked tightly without the need for any additional member for strengthening and any additional cost.

The expression of "the plug inserting direction crosses the direction in which the either one of members receives a tensile force" as used herein indicates that the direction in which the either one of member receives a tensile force is not in the same direction (including the parallel direction) in which the plug is inserted. For example, when the plug inserting direction crosses that in which the member receives the tensile force at right angles, strength of the component along the plug inserting direction becomes substantial zero, and then the plug keeps hooked more tightly.

In the buckle according to the present invention, the socket preferably includes a socket body with a rear surface thereof attached to the either one of members, and a guide groove formed on a top surface of the socket body along the inserting direction of the plug and having a dovetail form with an edge thereof in the inserting direction opened, and also the plug preferably includes a plug body with the rear surface thereof contacting a top surface side of the socket body and also with a pull section provided on the top surface, a slide section formed on a rear surface of this plug body, engaging with the guide groove of the socket and capable of sliding, and the mounting section formed on the pull section of the plug body.

The dovetail form as used herein indicates that a rear portion of the groove is wider than a front portion thereof, and there is no restriction over a form of the cross section.

With the configuration, the socket and the plug are coupled to each other with a structure for engagement between the dovetail-like guide groove formed on the socket body and the slide section formed on the plug body, so that the socket and the plug are hardly separated from each other against a force in any direction except a force acting in the sliding direction of the slide section. Especially, the socket and the plug are never separated from each other when a force orthogonal to the sliding direction of the sliding section is loaded thereto.

In addition, as the plug has the slide section formed on a rear surface of the plug body and the mounting section formed on a top surface thereof, namely as the mounting section to which a tensile force acts and the slide section receiving the tensile force are provided on the top and rear surfaces of the plug body at positions close to each other, a torque is seldom loaded to the slide section due to a force acting to the mounting section, so that the tensile force is sufficiently received.

In the buckle according to the present invention, the guide groove is preferably formed at two places on the socket body along the plug inserting direction with a space in between, and also the slide section is preferably formed at two places on the plug body along the plug inserting direction with a space in between.

With the configuration as described above, as each of the guide groove and the slide section engaging therewith is formed at two places on the socket body and the plug body respectively, it is expected that, when the plug is inserted into the socket, the plug is inserted into the socket smoothly without rattles in the inserting direction. Moreover in the state where the plug is inserted into the socket, as the socket is engaged with the plug at two places along the inserting direction (at the guide groove and the slide section), and therefore each section can receive the tensile force separately. As a result a high resistance against a relatively large tensile force is realized.

In the buckle of the present invention, the slide section and the mounting section of the plug are preferably formed on the plug body substantially along the direction in which the other member receives the tensile force.

With the configuration, as the slide section and the mounting section of the plug are formed on the plug body substantially along the direction in which the other member receives the tensile force, namely as the mounting section to which a tensile force acts and the slide section receiving the tensile force are formed on the plug body substantially along the acting direction of the tensile force, a torque seldom acts to the slide section due to the force acting to the mounting section, and the tensile force is received more securely.

In the buckle according to the present invention, the socket preferably has a tape insertion hole formed thereon for inserting and passing a tape used to attach the socket to the one of members therethrough along the plug inserting direction, and the mounting section of the plug is preferably provided as a mounting hole opened in a direction intersectional to the inserting direction of the tape inserted into the tape insertion hole of the socket as well as to the direction in which the other member receives the tensile force.

With this configuration, as the socket has the tape insertion hole formed thereon, the socket can be attached to the one member through the tape insertion hole. The mounting section of the plug is formed as a mounting hole, so that the other member is connected and secured to the plug using the mounting hole. Moreover the mounting hole is opened in the direction intersectional to the inserting direction of the tape as well as to the direction in which the other member receives the tensile force, so that in the state where the tape is orthogonal to the other member, the other member can be inserted into, passed and secured to the plug without being twisted even in a case where the other member is a belt.

It is preferable in the buckle of the present invention that the plug body has a rear face wall section contacting a top surface of the socket body and a pull section formed at a center of a top surface of this rear face wall section in the projecting state in the direction intersectional to the inserting direction of the plug.

With the configuration, as the plug body includes a rear face wall section contacting a top surface of the socket body, and a pull section formed at the center of the top surface of this rear face wall section, the user can insert or pull out the plug into or from the socket by holding the pull section. The plug body has a rear face wall section contacting a top surface of the socket body, which prevents the user's hands or fingers holding the pull section from being pinched in the guide groove of the socket.

The buckle of the present invention preferably includes a hooking unit for hooking the plug in the socket in the state where the plug has been inserted to a prespecified position therein, and a releasing unit for releasing the hooking state of the hooking unit.

With the configuration, as the buckle has the hooking unit for hooking the plug in the socket, the plug is hooked automatically in the socket just by inserting the plug to the socket to the prespecified position therein. Namely, the movement in the plug extracting direction is restricted. In addition, as the buckle has the releasing unit for releasing the hooking state of the hooking unit, the user can easily unhook the plug from the socket just by operating the releasing unit and releasing the hooking state of the hooking unit.

In the buckle of the present invention, the hooking unit preferably includes a guide wall and a hooking section formed along the direction in which the plug is inserted into the socket, and an elastic hooking piece provided in the plug in the elastic deformation allowable state, elastically deformed, when the plug is inserting into the socket, by the guide wall in the direction inward into the plug, then elastically restored to the original form and hooked in the hooking section, and also the releasing unit preferably has an operating section provided at a position corresponding to the elastic hooking section of the plug for elastically deforming the elastic hooking piece in the direction inward into the plug.

With the configuration, when the plug is inserted into the socket, the elastic hooking piece of the plug is elastically deformed by the guide wall in the direction inward into the plug, and then elastically restored to the original form and hooked in the hooking section. Namely, the plug is hooked in the socket.

In the state described above, to unhook the plug from the socket, the user operates the operating section of the plug and deforms the elastic hooking piece in the direction inward into the plug. Then the elastic hooking piece is unhooked from the hooking section, so that the plug can be pulled out from the socket.

In the buckle of the present invention, the hooking unit preferably includes an elastic hooking projection formed in the socket and capable of elastically deforming, and a hooking hole formed in the plug and hooked with the elastic hooking projection when the plug is inserted into the socket, the elastic hooking section preferably has a guide wall for elastically deforming the elastic hooking projection in the direction inward into the socket with the plug when the plug is inserted into the socket and then elastically restoring the elastic hooking projection to the original form to hook the elastic hooking projection in the hooking hole when the hooking hole reaches the elastic hooking projection, and further the releasing unit preferably includes an operating section for elastically deforming the elastic hooking projection of the socket in the direction inward into the socket.

With the configuration, when the plug is inserted into the socket, the elastic hooking projection of the socket is elastically deformed by the plug in the direction inward into the socket, and then is hooked in the hooking hole after the elastic hooking projection is restored to the original form when the hooking hole of the plug reaches the elastic hooking projection. Namely, the plug is hooked in the socket.

In order to unhook the plug from the socket in the state above described, the user operates the operating section of the socket, elastically deforms the elastic hooking projection in the direction inward into the socket. The elastic hooking projection is unhooked from the hooking hole, and the plug can be pulled out from the socket.

In the buckle of the present invention, the hooking unit preferably includes a pair of elastic hooking pieces formed on either one of the socket and the plug, and a held pin formed held by the elastic holding pieces when the plug formed on either remaining one of the socket and the plug is inserted into the socket, and also the pair of elastic holding pieces preferably has a guide wall elastically deformed by the held pin in the direction in which the pieces move away from each other when the plug is inserted into the socket and then elastically restoring the original form when the held pin has passed therethrough, and a holding section formed at a position closer to the plug inserting side as compared to the guide wall for elastically holding the held pin.

With the configuration, when the plug is inserted into the socket, the held pin has passed as deforming the pair of elastic holding pieces (the guide wall) in the direction in which the pieces move away from each other. When the held pin reaches the holding section, the guide wall is restored to the original form, and then the holding section elastically holds the pieces. Namely, the plug is hooked in the socket.

In the state described above, in order to unhook the plug from the socket, the user pull out the plug from the socket with a stronger force than a holding force at the holding section of the elastic holding pieces. Thereby the guide walls of the elastic holding pieces are elastically deformed in the direction in which the guide walls move away from each other, and therefore the held pin is released from the holding section. As a result the user can pull out the plug from the socket.

The baby carrier according to the present invention is characterized in that the buckle according to the present invention described above is used therein.

With the baby carrier described above, there is provided a baby carrier capable of providing the effects and advantages provided by the buckle according to the present invention described above.

DETAILED DESCRIPTION OF PREFERRED EMBODIMENT(S)

Embodiments of the present invention will be described with reference to the drawings below.

[First Embodiment]

Figure 1:
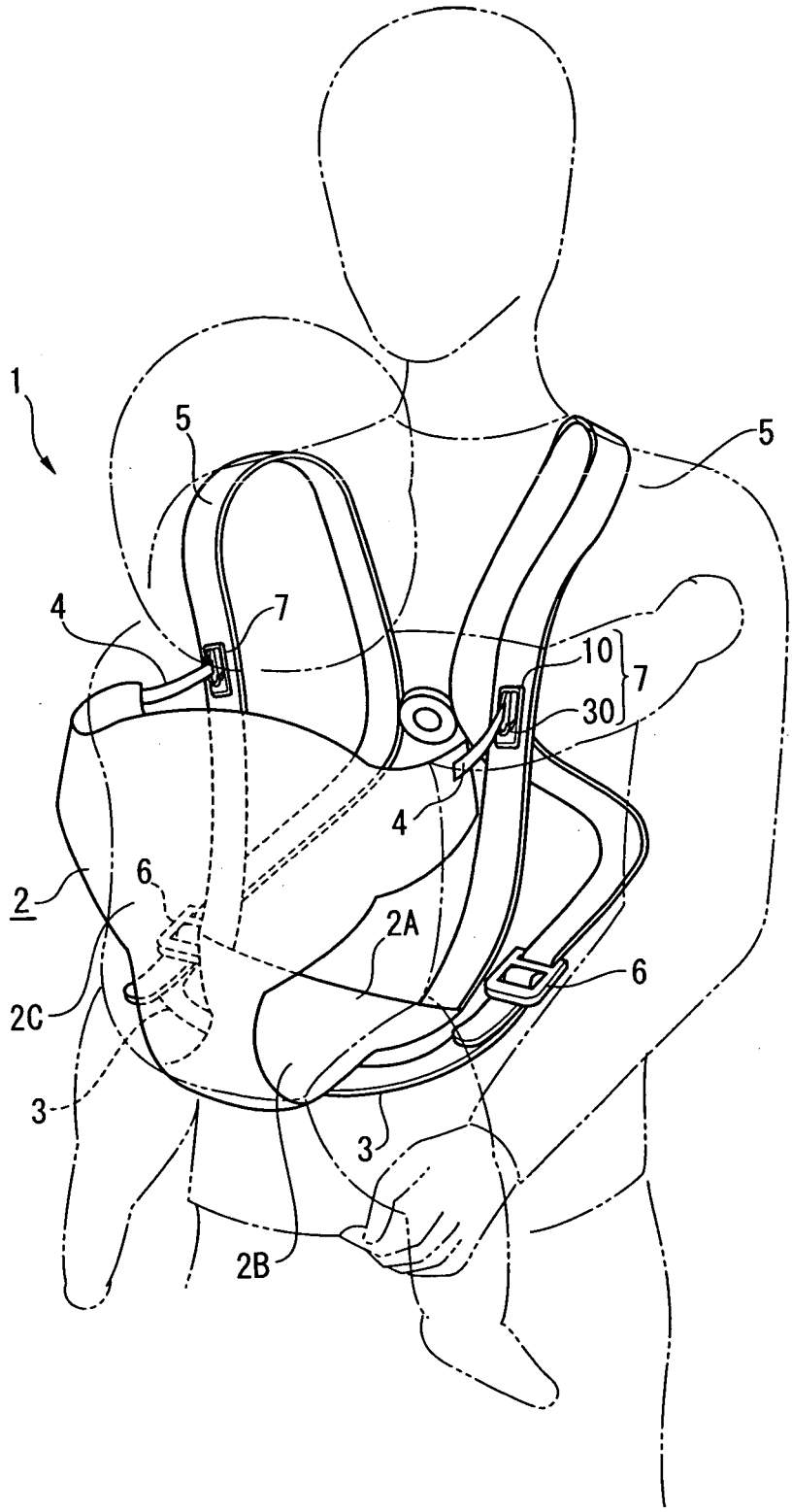
FIG. 1 is a perspective view showing a first embodiment of the present invention in which a buckle according to the present invention is applied to a baby carrier.
Figure 2:
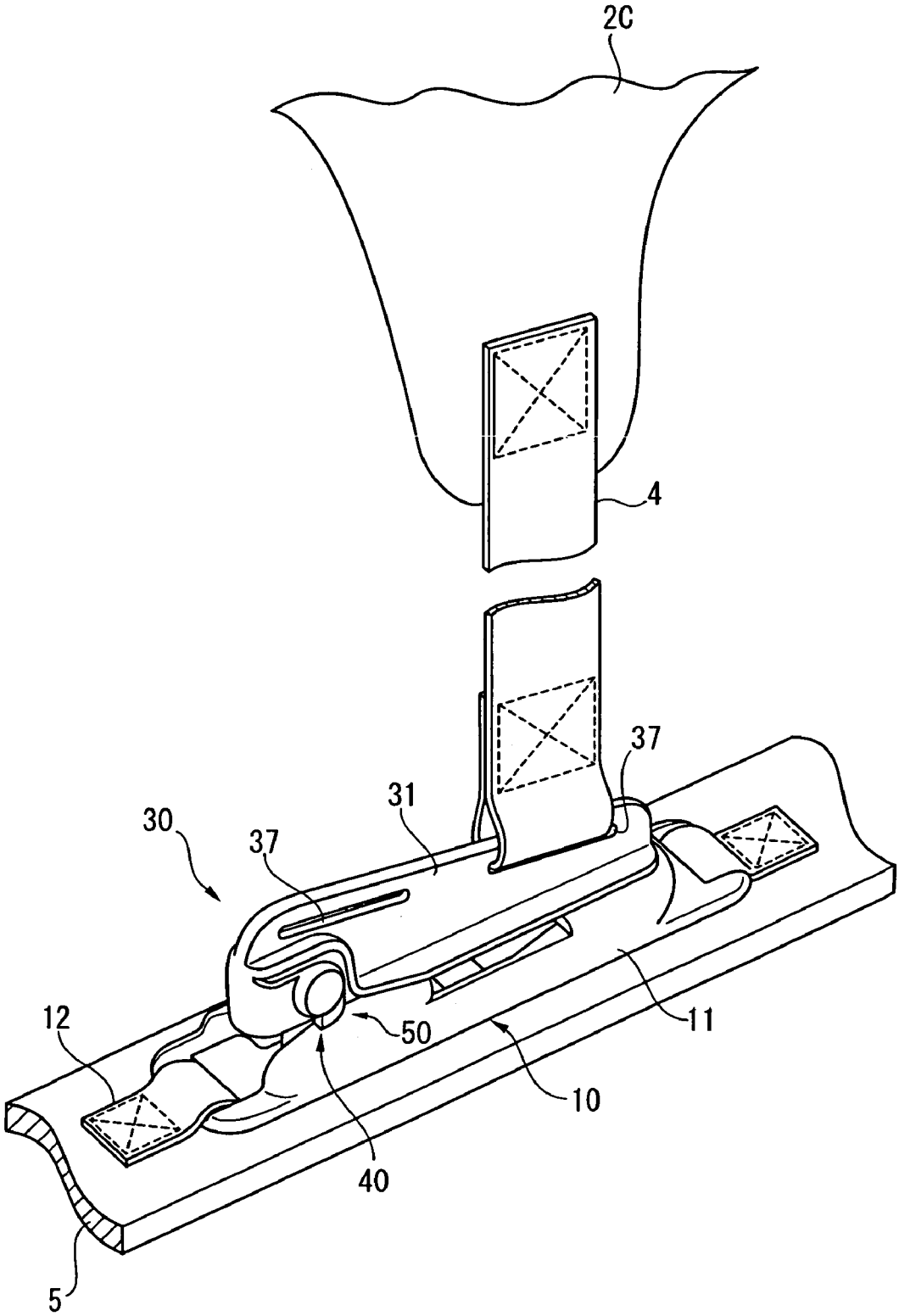
FIG. 2 is an enlarged perspective view showing the buckle used in the aforementioned embodiment.
Figure 3:
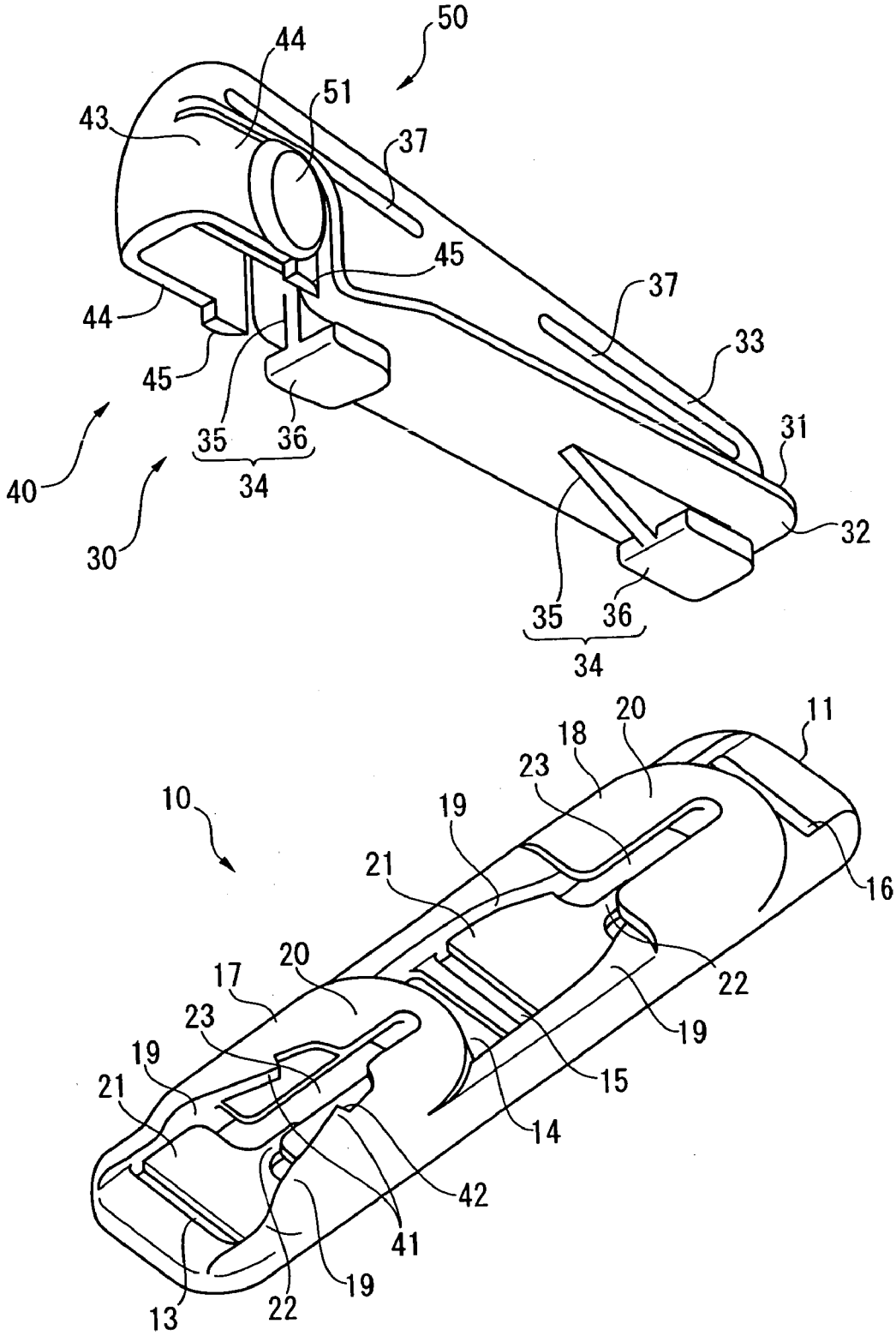
FIG. 3 is an exploded perspective view showing the buckle.
Figure 4:
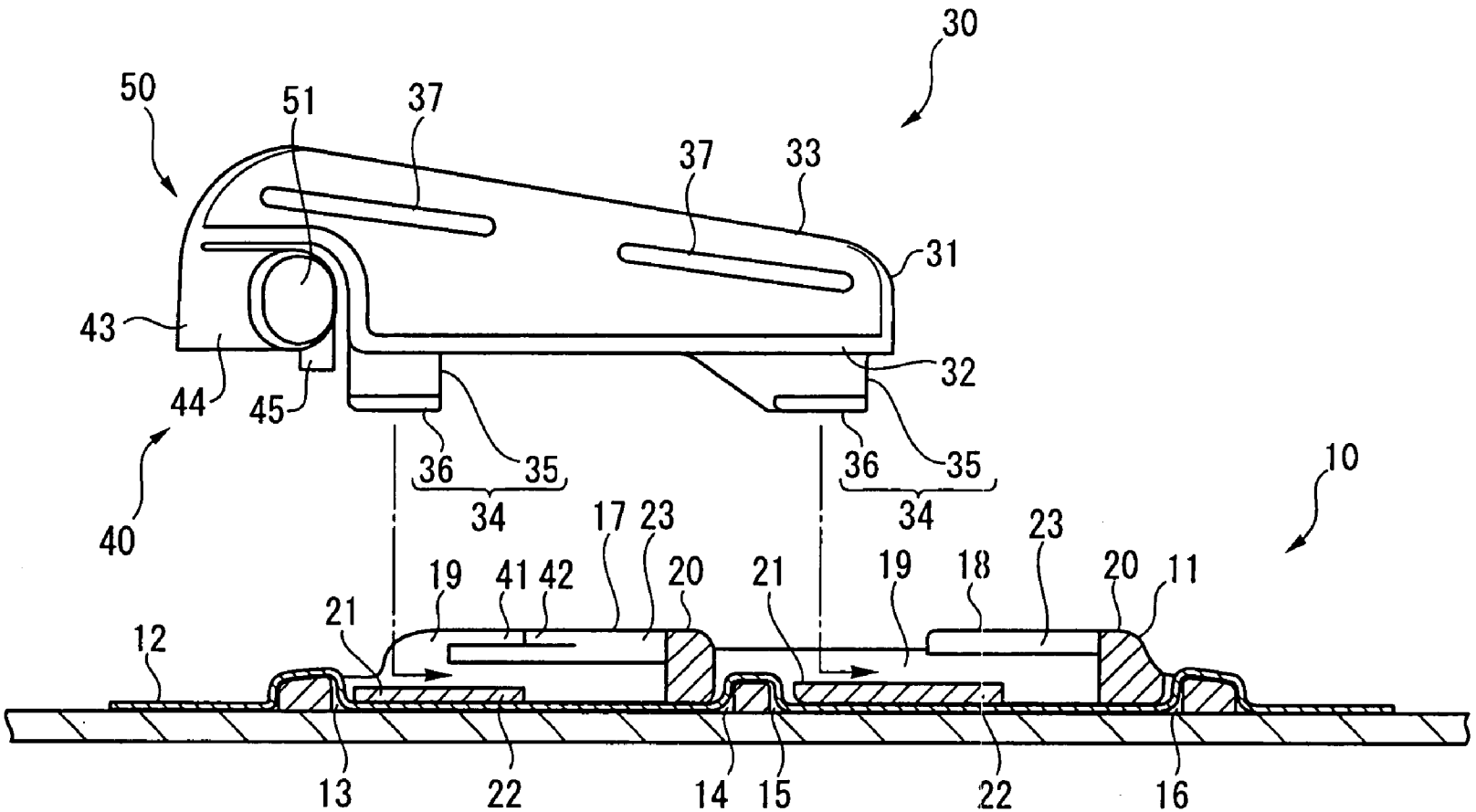
FIG. 4 is a view showing a socket and a plug of the buckle in the separated state.
Figure 5:
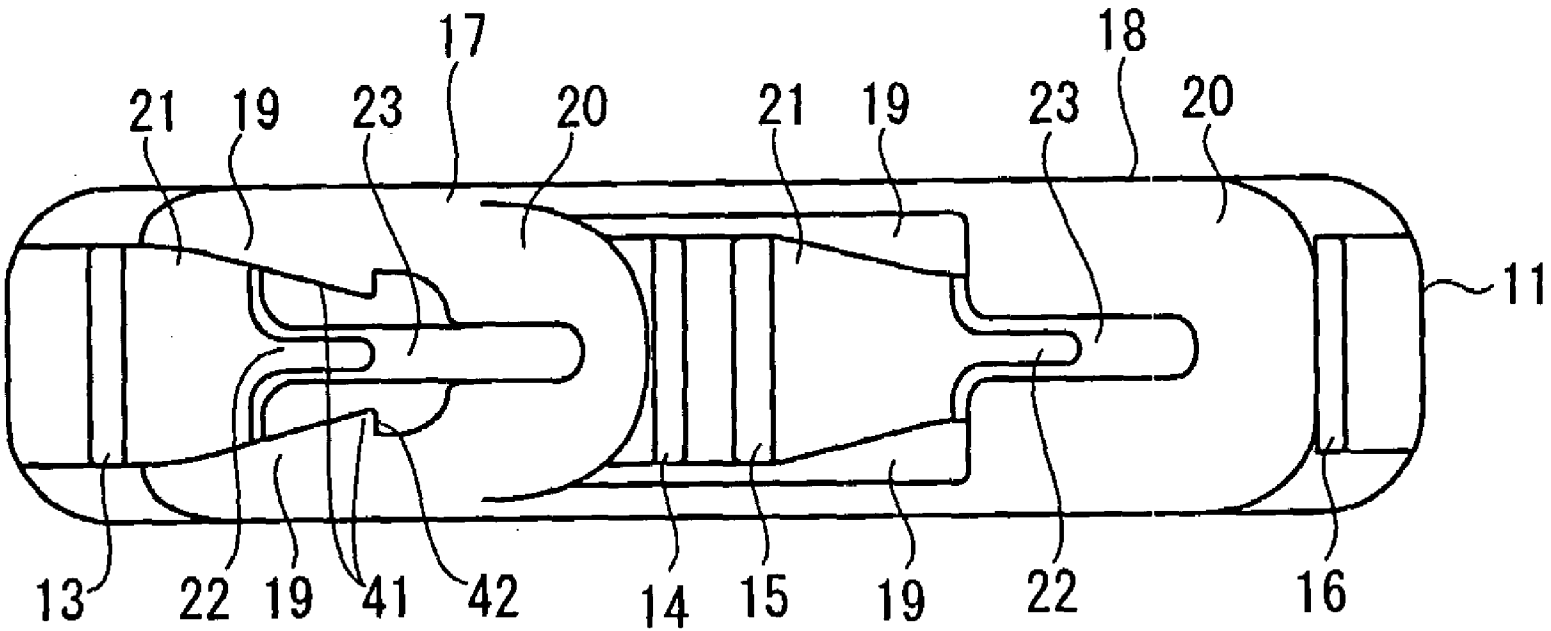
FIG. 5 is a plan view showing the socket of the buckle.
Figure 6:
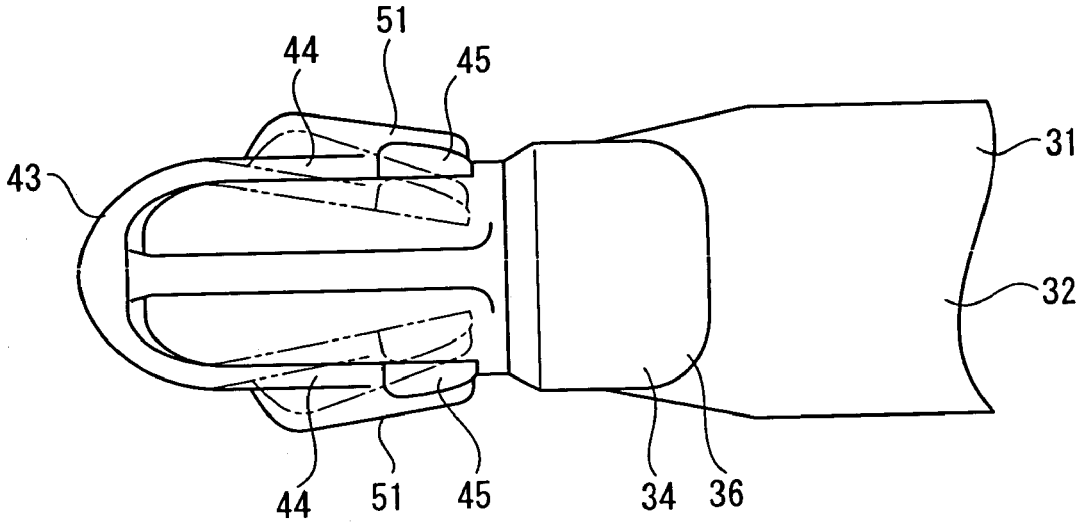
FIG. 6 is a bottom view showing the plug of the buckle.
Figure 7:
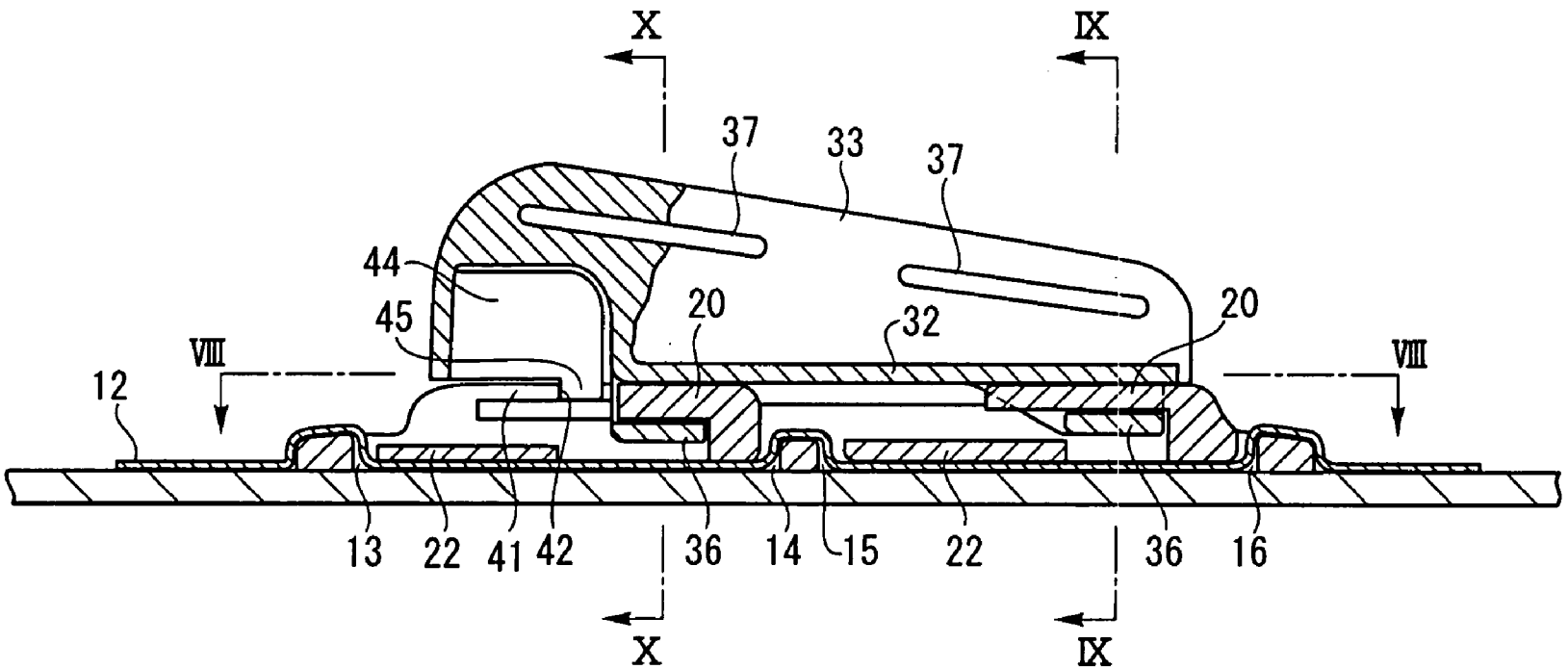
FIG. 7 is a cross-sectional view showing engagement between the socket and the plug of the buckle.
Figure 8:
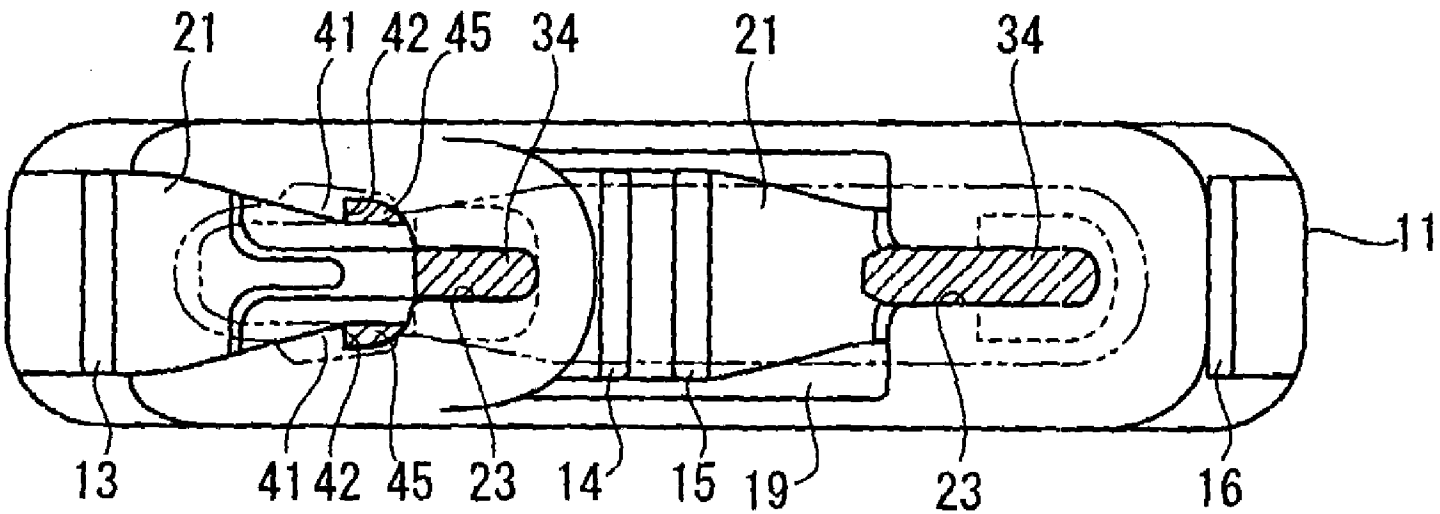
FIG. 8 is a view showing the state shown in FIG. 7 cross-sectioned along line VIII—VIII.
Figure 9:
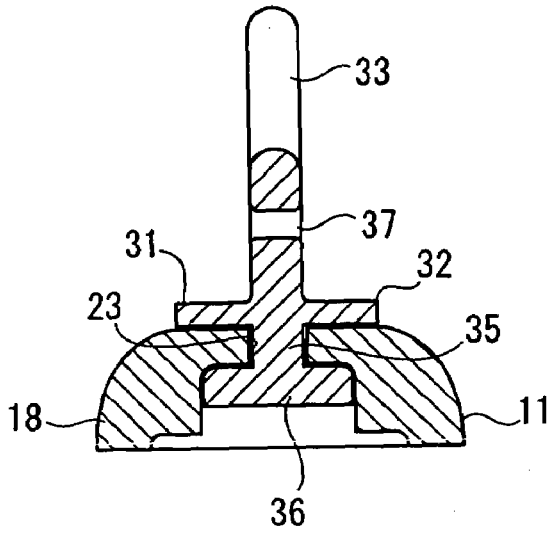
FIG. 9 is a view showing the state shown in FIG. 7 cross-sectioned along line IX—IX.
Figure 10:
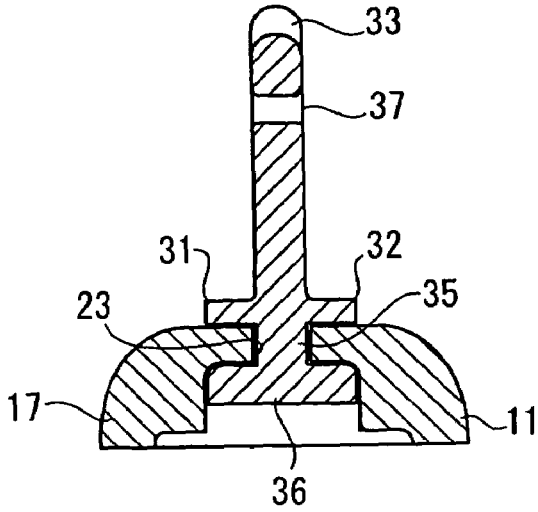
FIG. 10 is a view showing the state shown in FIG. 7 cross-sectioned along line X—X.

A first embodiment (an embodiment of a buckle according to the present invention applied to a baby carrier) is illustrated in FIGS. 1 to 10. FIG. 1 is a perspective view showing a baby carrier as a whole; FIG. 2 is an enlarged perspective view showing a buckle; FIG. 3 is an exploded perspective view showing the buckle; FIG. 4 is a view showing a socket and a plug of the buckle in the separated state; FIG. 5 is a plan view showing the socket of the buckle; FIG. 6 is a bottom view showing the plug of the buckle; FIG. 7 is a cross-sectional view showing engagement between the socket and the plug of the buckle; FIG. 8 is a view showing the state shown in FIG. 7 cross-sectioned along line VIII—VIII; FIG. 9 is a view showing the state shown in FIG. 7 cross-sectioned along line IX—IX; and FIG. 10 is a view showing the state shown in FIG. 7 cross-sectioned along line X—X.

A baby carrier 1 according to the first embodiment includes, as shown in FIG. 1, a carrier body 2, two shoulder belts 5, and four buckles 6, 7.

The carrier body 2 has a front member 2A, a crotch member 2B, and a back member 2C formed monolithically formed for supporting a belly, a crotch, and a back section for a baby respectively. Base ends of the shoulder belts 5 are attached to the right and left sides of the front member 2A respectively, and a ladder 6 is attached to a tip of each shoulder belt 5. Belt members 3 are attached to right and left sides of the crotch member 2B, and a tip of the belt member 3 is engaged with the ladder 6 with the length thereof capable of being adjusted. Male members (plug) 30 of the buckles 7 are attached to the right and left shoulder sections of the back member 2C via belt members 4, and female members (sockets) 10 of the buckle 7 are attached to the intermediate parts of shoulder belts 5. The buckle 7 according to the present invention is formed with the plug 30 and the socket 10.

The buckle 7 includes, as shown in FIGS. 2, 3 and 4, a socket 10, a plug 30 capable of being inserted into this socket 10 and hooked in the socket 10 in the state where the plug 30 is inserted to a prespecified position, a hooking unit 40 for hooking the plug 30 in the socket 10 in the state where the plug 30 has been inserted to a prespecified position therein, and a releasing unit 50 for releasing the hooking state of the hooking unit 40.

The socket 10 has, as shown in FIGS. 2, 3, 4, 5 and 7, a socket body 11 formed into a rectangular plate by injection molding of synthetic resin and having a rear surface thereof attached to the shoulder belt 5.

The socket body 11 has tape insertion holes 13 to 16 each formed thereon for inserting and passing a tape 12 used to attach the socket 10 to the shoulder belt 5 at the both ends and intermediate portion in the longitudinal direction. Tape 12 is inserted through the tape insertion hole 13 to the rear side of the socket body 11, through the tape insertion hole 14 to the front surface of the socket body 11, through the tape insertion hole 15 to the rear side of the socket body 11, and through the tape insertion hole 16 to the front surface of the socket body 11 accordingly, and both ends are sewn fixedly to the shoulder belt 5 outside of the both ends in the longitudinal direction of the socket body 11. With this configuration, the socket body 11 is fixed to the shoulder belt 5.

Engaging projections 17, 18 are formed between tape insertion holes 13 and 14 and between tape insertion holes 15 and 16, or with a space in between along the inserting direction of the plug 30 respectively. The engaging projections 17, 18 includes side walls 19 provided in the upright state on both sides in the width direction of the socket body 11, and a top wall 20 bridged between substantially front halves of the top ends of the side walls 19 in the inserting direction of the plug 30.

In the space where the top wall 20 is not provided, a flat plate 21 is bridged between the side walls 19 on both sides. The flat plate 21 is formed over from the tape insertion holes 13, 15 to the substantially central section of the engaging projections 17, 18, and includes a thin rod-like guide strip 22 at the end of the central section, capable of tucking the tape 12 into the shoulder belt 5 and of guiding a slide of the plug 30.

There is provided a guide groove 23 formed along the inserting direction of the plug 30 on the top wall 20. The guide groove 23 has a dovetail shape with the deeper area of the groove wider than the width of the groove seen from above (cross-section has a reverse T form) and is opened at one end (left side in FIG. 4) in the inserting direction of the plug 30.

The plug 30 has, as shown in FIGS. 2, 3, 4, 6 and 7, a plug body 31 formed by injection molding of synthetic resin and having a rear surface thereof contacting the top surface of the socket body 11.

The plug body 31 includes a rear face wall section 32 contacting a top surface of the socket body 11 and a pull section 33 monolithically formed at a center of a top surface of this rear face wall section 32 in the projecting state in the direction intersectional to the inserting direction of the plug 30 and along the inserting direction of the plug 30.

Two slide sections 34 are formed along the inserting direction of the plug 30 with a space therebetween on a rear face wall section 32. The slide section 34 is provided with a form allowing for engagement with the guide groove 23 of the socket 10 and capable of sliding, or namely with a reverse T form having a coupling piece 35 provided in the upright state from the bottom surface of the rear face wall section 32 and an inserting piece 36 orthogonal to the coupling piece 35 and parallel to the rear face wall section 32.

A mounting hole 37 is formed on the pull section 33 at a position corresponding to the position of each slide section 34, as a mounting section attached with a belt member 4 being another member. Namely, the slide section 34 and the mounding hole 37 of the plug 30 are formed on the plug body 31 substantially along the direction in which the belt member 4 receives the tensile force. The mounting hole 37 is opened in the direction intersectional (substantially orthogonal) to the inserting direction of the tapes 12 inserted through the tape insertion holes 13 to 16 of the socket 10 and the direction of the tensile force received by the belt member 4 being the other member.

The hooking unit 40 includes, as shown in FIGS. 2, 3, 4, 5, 6 and 7, a guide wall 41 and a hooking section 42 each formed along the direction in which the plug 30 is inserted into the socket 10 at the engaging projection 17, and elastic hooking pieces 43 provided in the plug 30 in the elastic deformation allowable state.

The guide wall 41 is formed into a tapered shape at the upper thick section of the top wall 20 of the engaging projection 17 of the socket 10 narrowing in the inserting direction of the plug 30. The hooking section 42 is formed contiguously from the guide wall 41, widening from the guide wall 41 in the inserting direction of the plug 30 and then gradually narrowing.

The elastic hooking piece 43 is elastically deformed by the guide wall 41, when the plug 30 is inserted into the socket 10, in the direction inward into the plug 30, then elastically restored to the original form and hooked in the hooking section 42 upon reaching the hooking section 42. More specifically, the elastic hooking piece 43 includes a pair of elastic hooking detents 44 formed together from the rear end of the inserting direction of the plug 30 towards both sides in the width direction of the plug 30 and also in the inserting direction of the plug 30. A tip of each elastic hooking detent 44 is provided with a detent section 45 projected to be hooked by the hooking section 42.

The releasing unit 50 is, as shown in FIGS. 2, 3 and 4, includes an operating section provided at a position corresponding to the elastic hooking detent 44 of the plug 30 for elastically deforming the elastic hooking detents 44 in the direction inward into the plug 30. More specifically, an operation button 51 is monolithically formed outside the position corresponding to each elastic hooking detent 44 of the plug 30.

In order to use a baby carrier 1 according to this embodiment, a male member 6A of the buckle 6 is engaged with a female member 6B, and also the socket 10 of the buckle 7 is engaged with the plug 30. Namely, a user holds the pull section 33 of the plug 30 to insert the plug 30 into the socket 10. This allows assembling into the state shown in FIG. 1.

When a baby is accommodated in the baby carrier 1 assembled in this way, a force in the direction moving away from the shoulder belt 5 is applied to the back member 2C of the carrier body 2. Also the same force acts to the belt member 4. Then, the socket 10 and the plug 30 of the buckle 7 are attached to the shoulder belt 5 and the belt member 4 so that the inserting direction of the plug 30 crosses (substantially orthogonal to) the direction in which the belt member 4 receives the tensile force.

Thus, when a relatively large tensile force is loaded to the belt member 4, the tensile force is divided into a component force along the extracting direction of the plug 30 and a component force orthogonal thereto. In this way, the force in the extracting direction of the plug 30 is reduced proportionally and the plug 30 can resist extraction with a relatively large tensile force. In this example, because the inserting direction of the plug 30 is intersectional to the direction in which the belt member 4 receives the tensile force, the component force in the extracting direction of the plug 30 is substantially zero, and therefore the plug 30 is not easily extracted.

With the first embodiment, the following effects can be expected.

(1) Since the insertion and extraction of the plug 30 can be performed by holding the pull section 33 of the plug 30, insertion and extraction of the plug 30 are easier as compared to insertion and extraction by holding a rear section of the plug as required in the conventional technology. Namely, since the pull section 33 is provided in the direction intersectional to the inserting direction of the plug 30, it is easy to hold the pull section 33 and to slide the plug 30.

(2) Since the inserting direction of the plug 30 is intersectional to the direction of the tensile force applied to the belt member 4, a smaller force is loaded to the plug 30 in the extracting direction so that the plug 30 is not easily extracted even with a relatively large tensile force. In this way, the baby carrier according to this embodiment can prevent the back member 2C from leaving and falling off from a user without the need for adding any special components, and can be used safely.

(3) Since the socket 10 and plug 30 are configured to couple with each other based on the structure for engagement including a reverse T-shaped dovetail guide groove 23 formed on the socket body 11 and the slide section 34 formed on the plug body 31 with a reverse T shape, the plug 30 is not easily extracted by forces except that acting in the sliding direction of the slide section 34. In this embodiment, the tensile force is applied in the direction intersectional to the sliding direction of the slide section 34, and the plug 30 is hardly extracted.

(4) Furthermore, since the plug 30 has the slide section 34 formed on the rear surface of the plug body 31 and the mounting hole 37 formed on the top surface, or since the mounting hole 37 with a tensile force loaded thereto and the slide section 34 accepting the tensile force are provided adjacent to each other on the top and rear surfaces of the plug body 31, only a small torque is loaded to the slide section 34 by the force applied to the mounting hole 37, so that the tensile force is sufficiently endured.

Especially because the slide section 34 and the mounting hole 37 of the plug 30 are formed on the plug body 31 substantially along the direction in which the belt member 4 receives the tensile force, or because the mounting hole 37 with a tensile force loaded thereto and the slide section 34 accepting the same are provided on the plug body 31 substantially along the direction in which the tensile force is applied, only a small torque is loaded to the slide section 34 by the force applied to the mounting hole 37, which also makes the plug 30 harder to be extracted.

(5) Since the guide grooves 23 and the slide sections 34 engaging therewith are formed at two places on the socket body 11 and the plug body 31 respectively, the plug 30 seldom rattles in the inserting direction when the plug 30 is inserted into the socket 10. Furthermore, since the socket 10 and the plug 30 are engaged at two positions in the inserting direction (the guide groove 23 and the slide section 34) in the state where the plug 30 is inserted in the socket 10, the tensile force can be divided to two components. Thus, strength against a relatively large tensile force can be ensured.

(6) Since the tape insertion holes 13 to 16 are formed in the socket 10, the socket 10 can be sewn tightly to the shoulder belt 5 using the tape insertion holes 13 to 16. Since the mounting hole 37 is formed on the plug 30, the belt member 4 can be fixedly coupled using the mounting hole 37. In addition, since the mounting hole 37 is opened in the direction intersectional to the inserting direction of the tape 12 as well as to the direction of the tensile force received by the belt member 4, even if the belt member 4 is made from a strip-shaped member, the tape 12 and belt member 4 can be inserted and fixed without being twisted in the state where the tape 12 and the belt member 4 are orthogonal to each other.

(7) Since the plug body 31 includes the rear face wall section 32 contacting the top surface of the socket body 11 and the pull section 33 formed at the center of the top surface of this rear face wall section 32 in the projecting state, the plug 30 can be inserted into or extracted from the socket 10 by being held at the pull section 33. In this step, the rear face wall section 32 contacting the top surface of the socket body 11 can prevent user's hand or fingers holding the pull section 33 from being pinched by the guide groove 23 of the socket 10.

Furthermore, since the rear face wall section 32 is configured to hold the top wall 20 of the guide groove 23 from the top and bottom thereof together with the inserting piece 36 of the slide section 34, rattling of the plug 30 in the vertical direction (in the direction orthogonal to the inserting direction) can also be reduced.

(8) With the hooking unit 40 for hooking the plug 30 in the socket 10, the plug 30 can automatically be hooked to the socket 10 only by inserting the plug 30 to a prespecified position therein.

With the releasing unit 50 for releasing the hooking state of the hooking unit 40, the hooking state of the hooking unit 40 can be released by operating the releasing unit 50 when the plug 30 is extracted from the socket 10, allowing easy extraction of the plug 30 from the socket 10.

(9) Since the hooking unit 40 includes the guide wall 41 and the hooking section 42 formed along the direction in which the plug 30 is inserted into the socket 10, and the elastic hooking piece 43 provided in the plug 30 in the elastic deformation allowable state, elastically deformed, when the plug 30 is inserted into the socket 10, by the guide wall 41 in the direction inward into the plug 30, then elastically restored to the original form and hooked in the hooking section 42 upon reaching the hooking section 42, when the plug 30 is inserted into the socket 10, the elastic hooking piece 43 of the plug 30 is elastically deformed in the direction inward into the plug 30, then elastically restored to the original form and hooked in the hooking section 42 upon reaching the hooking section 42. Thus, the plug 30 can be hooked to the socket 10 only by inserting the plug 30 into the socket 10.

(10) Since the releasing unit 50 includes the operating button 51 provided at a position corresponding to the elastic hooking piece 43 of the plug 30 for elastically deforming the elastic hooking piece 43 in the direction inward into the plug 30, the detent section 45 is removed from the hooking section 42 when the operation button 51 of the plug 30 is pressed for operation to elastically deform the elastic hooking piece 43 in the direction inward into the plug 30. Thus, the plug 30 and the socket 10 can be disassembled only by extracting the plug 30 from the socket 10 with pressing the operation button 51.

[Second Embodiment]

Figure 11:
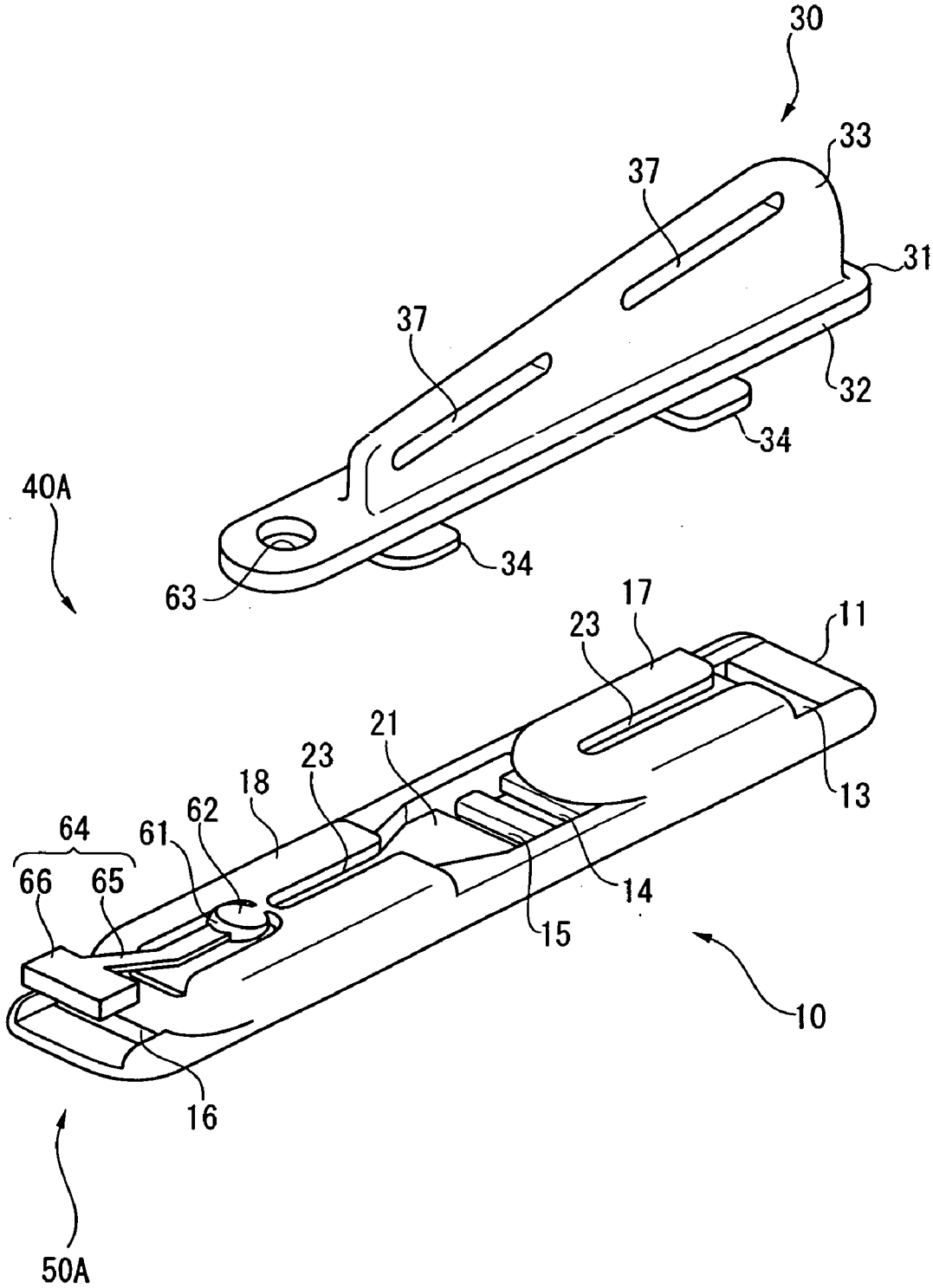
FIG. 11 is an exploded perspective view showing a buckle according to a second embodiment of the present invention.

A buckle according to a second embodiment is shown in FIG. 11. FIG. 11 is an exploded perspective view showing the state where a plug 30 and a socket 10 are separated from each other. To explain the second embodiment, the same signs are assigned to the same components as those in the first embodiment and their descriptions are omitted or simplified.

The buckle according to the second embodiment has a hooking unit and a releasing unit different from that in the first embodiment as shown in FIG. 11.

A hooking unit 40A according to the second embodiment includes an elastic hooking projection 61 formed on a socket 10 and capable of elastically deforming, and a hooking hole 63 formed on a plug 30 and hooked with the elastic hooking projection 61 when the plug 30 is inserted into the socket 10.

The elastic hooking projection 61 has a short cylindrical form and is provided on the head side of a guide groove 23 in an engaging projection 18 on the socket 10, and projects upwards from the upper surface (top surface) of the engaging projection 18 in an elastic deformation allowable state. On the surface of the elastic hooking projection 61, a guide wall 62 is formed gradually inclining in the upward direction as it goes forward along the inserting direction of the plug 30. By the guide wall 62, the elastic hooking projection 61 is elastically deformed in the direction inward into the socket 10 when the plug 30 is inserted into the socket 10, and then elastically restored to the original form to be hooked in a hooking hole 63 when the hooking hole 63 reaches the elastic hooking projection 61.

A releasing unit 50A according to the second embodiment includes an operating section 64 for elastically deforming the elastic hooking projection 61 of the socket 10 in the direction inward into the socket 10. The operating section 64 includes a lever 65 extending monolithically from the elastic hooking projection 61 and an operating head 66 formed at the end of the lever 65 in a rectangle form.

According to the second embodiment, when inserting the plug 30 into the socket 10, the elastic hooking projection 61 of the socket 10 is deformed inward into the socket 10 by the edge of the plug 30, and then elastically restored to the original form to be hooked in the hooking hole 63 when the hooking hole 63 of the plug 30 reaches the elastic hooking projection 61. Namely, the plug 30 is hooked in the socket 10.

In this state, to release the plug 30 from the socket 10, the elastic hooking projection 61 is deformed inward into the socket 10 by pressing the operating section 64 of the socket 10. Then the elastic hooking projection 61 is released from the hooking hole 63, so that the plug 30 can be pulled out from the socket 10 in this state.

Figure 12:
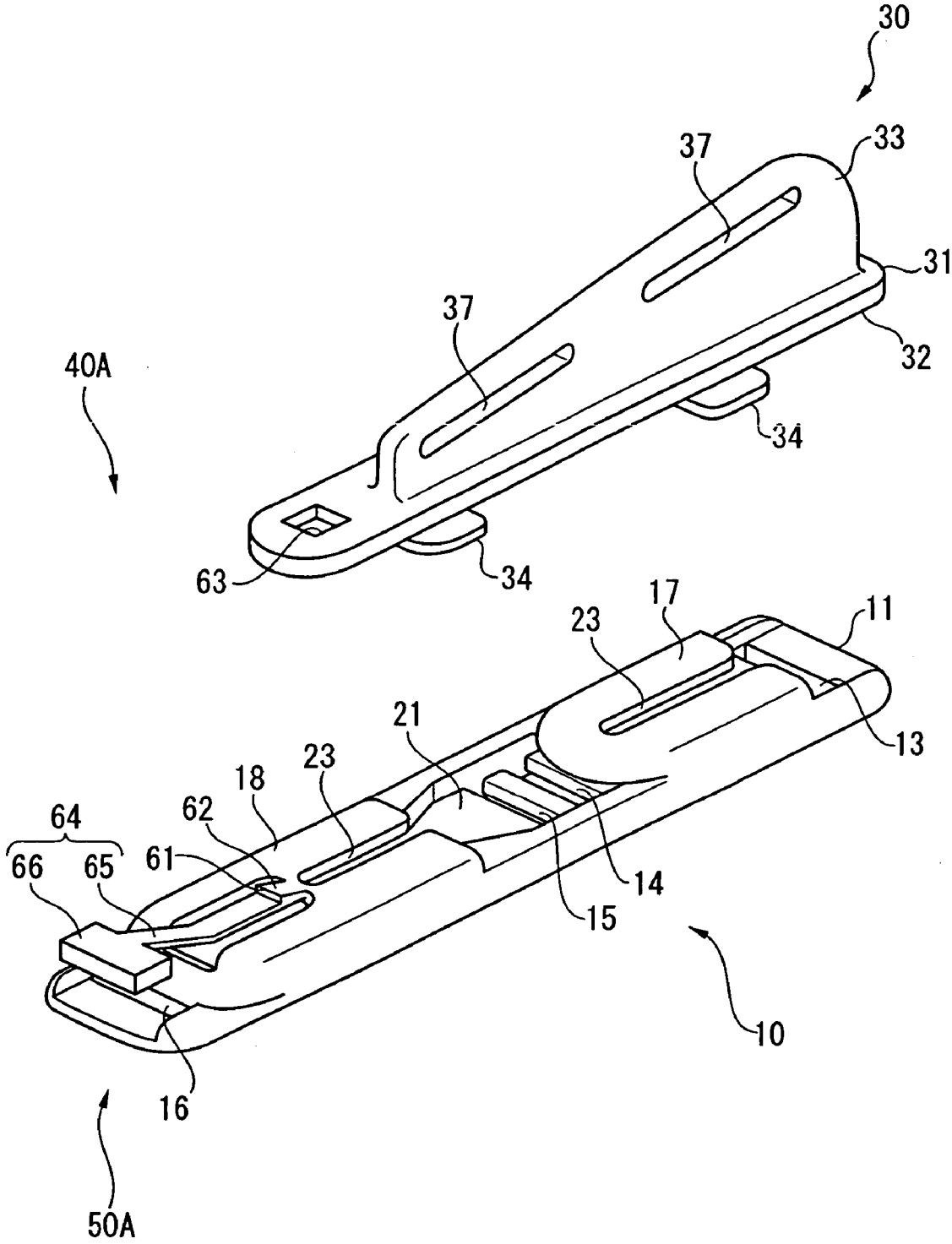
FIG. 12 is an exploded perspective view showing a modification of the second embodiment.

With the second embodiment, the similar effects can be expected also when a hooking unit 40A has the configuration as shown in FIG. 12. An elastic hooking projection 61 provided on the socket 10 has a rectangular form when viewed from the top, and also has a form with the top surface gradually inclining in the upward direction as it goes in the inserting direction and then in the downward direction, namely a form looking like a right triangle form when viewed from a side thereof. A hooking hole 63 provided on the plug 30 has a rectangular hole (square hole) for the elastic hooking projection 61 to hook therein.

[Third Embodiment]

Figure 13:
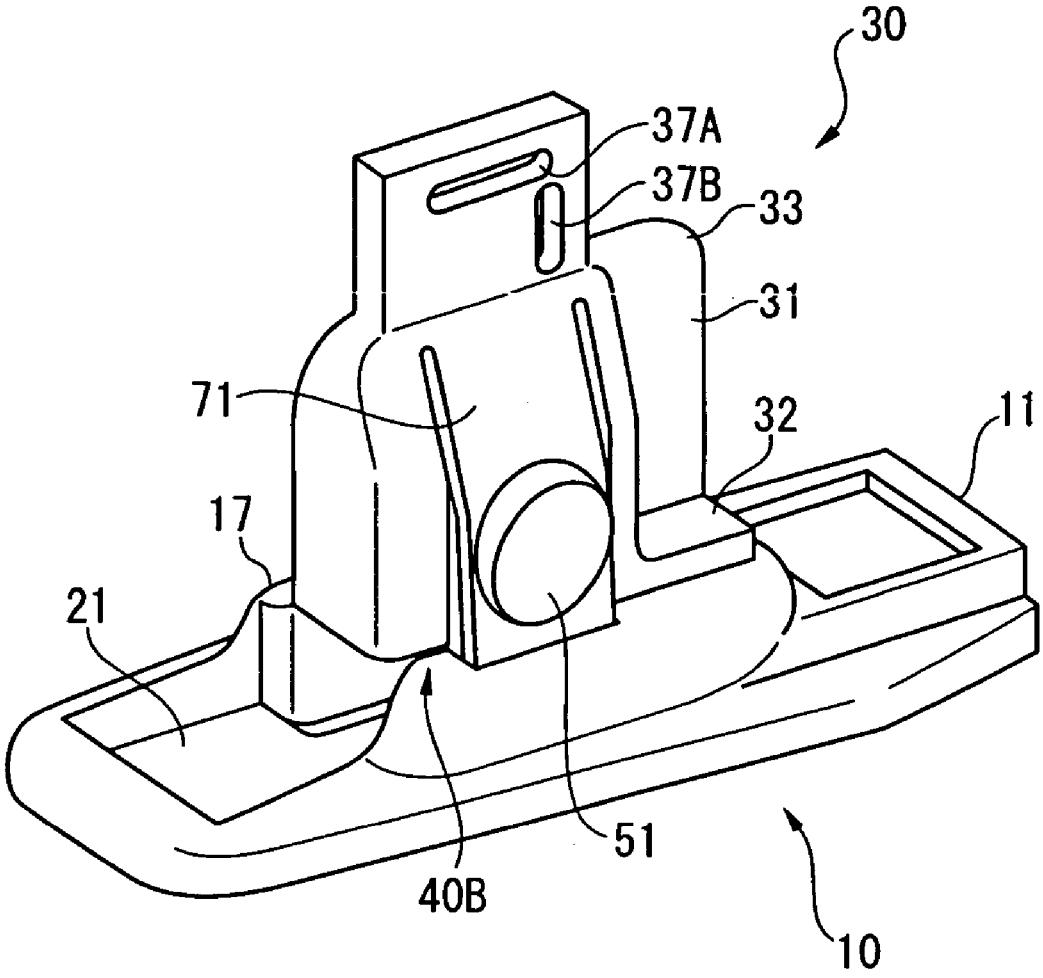
FIG. 13 is a perspective view showing a buckle according to a third embodiment of the present invention.
Figure 14:
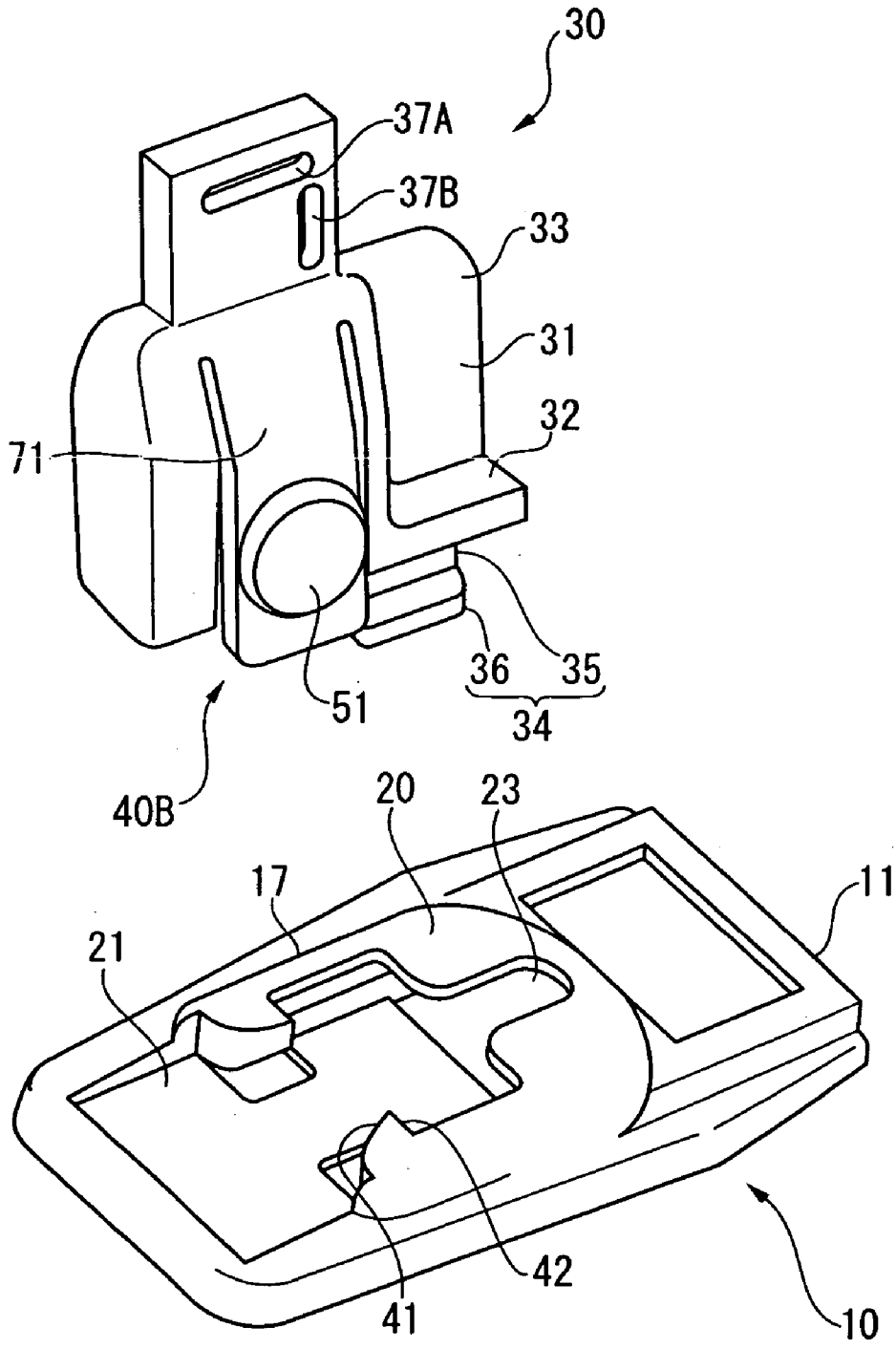
FIG. 14 is an exploded perspective view showing the buckle according to the aforementioned embodiment.

A buckle according to a third embodiment is shown in FIG. 13 and FIG. 14. FIG. 13 is a perspective view showing the state where a plug 30 is hooked in a socket 10, and FIG. 14 is a perspective view showing the state where the socket 10 and plug 30 are separated from each other. To explain the third embodiment, the same signs are assigned to the same components as those in the first embodiment and descriptions thereof are omitted or simplified.

A buckle according to the third embodiment has a hooking unit different from that in the first embodiment. While in the first embodiment the guide grooves 23 provided on the socket 10 and the slide sections 34 provided on the plug 30 are provided at two places along the inserting direction of the plug 30 with a space in between, a guide groove and a slide section are provided each at one place in the third embodiment. Further, while the socket 10 is fastened on the shoulder belt 5 with a tape 12 by sewing in the first embodiment, a socket 10 is fastened on a shoulder belt 5, for example, by bonding in the third embodiment.

In a hooking unit 40B according to the third embodiment, an elastic hooking pieces 71 provided on the plug 30 side is provided on a plug body 31 so that the elastic hooking pieces can elastically deform in the direction in which the hooking pieces 71 get closer to each other with respect to an axis in the same direction as the inserting direction of the plug 30 as shown in FIG. 13 and FIG. 14. Namely, in the elastic hooking pieces 71, a base end (upper end) is provided on the plug body 31 in an elastic deformation allowable state with respect to an axis in the same direction as the inserting direction of the plug 30 so that the tip end (lower end) can get closer to each other when elastically deformed.

With the third embodiment, when inserting the plug 30 into the socket 10 laterally, the elastic hooking pieces 71 of the plug 30 are deformed inward each other by a guide wall 41 of the socket 10, and then elastically restored to the original form to be hooked in the hooking section 42 when the elastic hooking pieces 71 reach the hooking section 42. Namely, the plug 30 is hooked in the socket 10.

In this state, to release the plug 30 from the socket 10, the elastic hooking pieces 71 are deformed inward each other by pressing the operating button 51 of the socket 10. Subsequently, the elastic hooking pieces 71 are released from the hooking section 42, so that the plug 30 can be pulled out from the socket 10 in this state.

In the third embodiment, two mounting holes 37A and 37B are formed on the upper side of a pull section 33 in the directions orthogonal to each other. While the mounting hole 37A is formed in the same direction as the mounting hole 37 in the first embodiment, the mounting hole 37B is formed in the direction orthogonal to the mounting hole 37A. When a belt member 4 is attached to the mounting hole 37A, a tensile force is applied in the direction intersectional to the inserting direction of the plug 30, while a belt member 4 is attached to the mounting hole 37B, a tensile force may be applied in the direction substantially parallel to the inserting direction of the plug 30.

[Fourth Embodiment]

Figure 15:
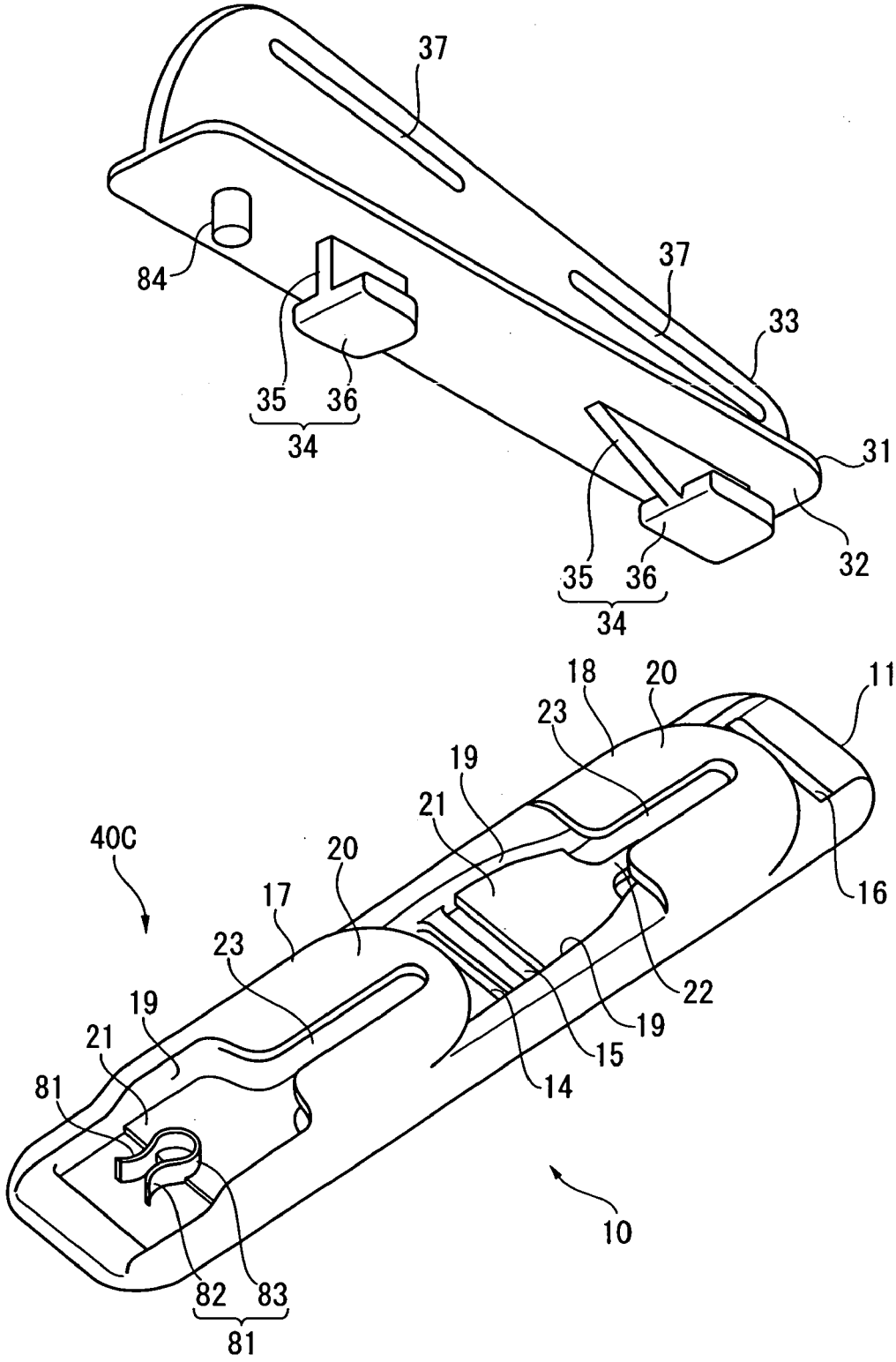
FIG. 15 is an exploded perspective view showing a buckle according to a forth embodiment of the present invention.

A buckle according to a fourth embodiment is shown in FIG. 15. FIG. 15 is a perspective view showing a separating state of a socket 10 and a plug 30. To explain the fourth embodiment, the same signs are assigned to the same components in the first embodiment and their descriptions are omitted or simplified.

In a buckle according to the fourth embodiment, a hooking unit is different from that in the first embodiment, and a releasing unit is not particularly provided as shown in FIG. 15.

A hooking unit 40C according to the fourth embodiment includes a pair of elastic holding pieces 81 formed on the socket 10, and a held pin 84 formed on the plug 30 to be held by the elastic holding pieces 81 when the plug 30 is inserted into the socket 10.

The pair of elastic holding pieces 81 is provided in front of an engaging projection 17 of the socket 10, and has guide walls 82 formed in a curved form approaching to each other towards along the inserting direction of the plug 30, and a holding section 83 formed with curved sides moving away from each other from the guide walls 82 towards the inserting direction of the plug 30 then again approaching and uniting.

According to the fourth embodiment, when inserting the plug 30 into the socket 10, the held pin 84 of the plug 30 passes elastically deforming the pair of the elastic holding pieces 81 (guide walls 82) of the socket 10 to the direction moving away from each other, and then when the held pin 84 reaches the holding section 83, the guide walls 82 are elastically restored to the original form, the held pin 84 is elastically held in the holding section 83. Namely, the plug 30 is hooked in the socket 10.

In this state, to release the plug 30 from the socket 10, the plug 30 is pulled out from the socket 10 with a force greater than the holding force of the holding section 83 of the elastic holding pieces 81. Then, the guide walls 82 of the elastic holding pieces 81 are elastically deformed in the direction of moving away from each other, namely the held pin 84 is released from the holding section 83, so that the plug 30 can be pulled out from the socket 10 in this state.

In the fourth embodiment, the socket 10 is provided with the pair of elastic holding pieces 81 and the plug 30 is provided with the held pin 84 respectively, also each of them may be provided with the other piece(s) in a swap. Namely, when the socket 10 is provided with a held pin 84 and the plug 30 is provided with a pair of elastic holding pieces 81, the similar effects can also be expected.

[Modifications]

The present invention is not limited to the embodiments described above, but also includes modifications and improvements within the scope in which the present invention can be achieved.

For example, in each embodiment described above, the socket 10 is attached to the shoulder belt 5, and the plug 30 is attached to the belt member 4, but the components may be attached in a reverse way. Namely, the socket 10 may be attached to the belt member 4, and the plug 30 may be attached to the shoulder belt 5. In this case, the belt member 4 can be fastened onto the rear face of the socket 10 with the aid of an appropriate means, and the shoulder belt 5 can be connected and secured to the mounting section (mounting hole) on the top surface of the plug 30.

In each embodiment described above, the shoulder belt 5 with the socket 10 attached thereto and the belt member 4 with the plug 30 attached thereto are both designed with a belt-like form, but the present invention is not limited to this configuration, and the components may be a strip member or a sheet member respectively.

In the first and the third embodiments, the guide grooves 23 are formed on the socket body 11 at two places along the inserting direction of the plug 30 with a space in between, and the slide sections 34 are formed on the plug body 31 at two places along the inserting direction of the plug 30 with a space in between, but the present invention is not limited to this configuration, and the components may be formed at one place or three or more places according to the purpose.

In the first and the third embodiments, the mounting holes 37 of the plug 30 corresponding to the slide sections 34 are formed on the plug body 31 substantially along the direction in which the plug 30 receives a tensile force, but also the holes may be formed in the intermediate part of the two slides.

In the first, the second, and the fourth embodiments, the socket 10 is fastened to the shoulder belt 5 with the tape 12 by sewing, but also the socket 10 may be fastened by bonding. The means for fastening the socket 10 and the plug to each member is not limited to fastening by sewing or bonding, but also fastening by caulking buttons may be employed.

Also the hooking unit and releasing unit are not limited to the configurations described in each of the embodiments. Particularly, a hooking unit is not limited to the configuration in which the plug 30 is automatically hooked in the socket 10 when the plug 30 is inserted into the socket 10, and also the configuration is allowable in which the plug 30 to be hooked in the socket 10 by lever operation when the plug 30 is inserted into a predetermined position. In this case, also the releasing unit 50 should preferably have the structure corresponding to the structure of the hooking unit 40.

The priority application Number JP2004-136685 upon which this patent application is based is hereby incorporated by reference.

What is claimed is:

1. A buckle for coupling or separating a pair of members, comprising:

a socket; and a plug capable of being inserted into the socket and hooked in the socket in the state where the plug is inserted to a prespecified position, wherein the socket is attached to a one member of the pair of members, and the plug has a pull section projecting in a direction intersectional to the inserting direction of the plug, and a mounting section for mounting thereon the other member of the pair of members is provided on the pull section, further comprising a hooking unit for hooking the plug in the socket in the state where the plug has been inserted to a prespecified position therein, and a releasing unit for releasing the hooking state of the hooking unit, wherein the hooking unit includes a hooking section provided on one of the socket and the plug and formed along the direction in which the plug is inserted into the socket, and an elastically deformable hooking piece provided in the other of the socket and the plug, wherein the hooking piece is elastically deformed, when the plug is inserted into the socket, by a guide wall in the direction inward into the plug, then elastically restored to the original form and hooked in the hooking section upon reaching the hooking section, and the releasing unit has an operating section provided at a position corresponding to the elastic hooking sections of the plug for elastically deforming the elastic hooking piece in the direction inward into the plug.

2. The buckle according to claim 1, wherein the socket is attached to the one member so that the inserting direction of the plug crosses the direction in which the other member receives a tensile force.

3. The buckle according to claim 1, wherein the socket has a socket body with a rear surface thereof attached to the one member and a guide groove formed on a top surface of the socket body along the inserting direction of the plug and having a dovetail form with an edge thereof in the inserting direction opened, and the plug has a plug body with a rear surface thereof contacting a top surface side of the socket body and also with a pull section provided on a top surface of the plug body, a slide section formed on a rear surface of the plug body, engaging with the guide groove of the socket and capable of sliding, and the mounting section formed on the pull section of the plug body.

4. The buckle according to claim 3, wherein the guide groove is formed at two places on the socket body along the inserting direction of the plug with a space in between, and the slide section is formed at two places on the plug body along the inserting direction of the plug with a space in between.

5. The buckle according to claim 3, wherein the slide section and the mounting section of the plug are formed on the plug body substantially along the direction in which the other member receives a tensile force.

6. The buckle according to claim 1, wherein the socket has tape insertion holes formed thereon each for inserting and passing a tape used to attach the socket to the one member therethrough along the inserting direction of the plug, and the mounting section of the plug is a mounting hole opened in a direction intersectional to the inserting direction of the tape inserted into each of the tape insertion holes of the socket as well as to the direction in which the other member received a tensile force.

7. The buckle according to claim 3, wherein the plug body has a rear face wall section contacting a top surface of the socket body and the pull section formed at a center of a top surface of the rear face wall section in the projecting state in the direction intersectional to the inserting direction of the plug.

8. A buckle for coupling or separating a pair of members, comprising:

a socket; and a plug capable of being inserted into the socket and hooked in the socket in the state where the plug is inserted to a prespecified position, wherein the socket comprises:

a socket body;

side walls vertically provided on an upper side of the socket body;

a top wall stretching between upper ends of the side walls;

a guide groove provided on the top wall and extending along an inserting direction of the plug; and a member attachment for one of the pair of members to be attached, wherein the plug comprises:

a plug body;

a coupling piece vertically provided on a bottom side of the plug body;

a slide section provided on the coupling piece and having an inserting piece vertically spaced along the inserting direction extending parallel to a rear face wall section of the plug body, and a pull section projecting from a top side of the plug body in a direction intersectional to the inserting direction of the plug, and a mounting section for mounting thereon the other member of the pair of members is provided on the pull section.

9. The buckle according to claim 8, wherein the socket is attached to the one member so that the inserting direction of the plug crosses the direction in which the other member receives a tensile force.

10. The buckle according to claim 8, wherein the socket body has a rear surface thereof attached to the one member and the guide groove having a dovetail form with an edge thereof in the inserting direction opened, and the plug body has a rear surface thereof contacting a top surface side of the socket body and the slide section engaging with the guide groove of the socket and capable of sliding, and the mounting section formed on the pull section of the plug body.

11. The buckle according to claim 8, wherein the socket has tape insertion holes formed thereon each for inserting and passing a tape used to attach the socket to the one member therethrough along the inserting direction of the plug, and the mounting section of the plug is a mounting hole opened in a direction intersectional to the inserting direction of the tape inserted into each of the tape insertion holes of the socket as well as to the direction in which the other member received a tensile force.

12. The buckle according to claim 8, further comprising:

a hooking unit for hooking the plug in the socket in the state where the plug has been inserted to a prespecified position therein; and a releasing unit for releasing the hooking state of the hooking unit.

13. The buckle according to claim 12, wherein the hooking unit includes a guide wall and a hooking section formed along the direction in which the plug is inserted into the socket, and an elastic hooking piece provided in the plug in the elastic deformation allowable state, the hooking piece being elastically deformed, when the plug is inserted into the socket, by the guide wall in the direction inward into the plug, then elastically restored to the original form and hooked in the hooking section upon reaching the hooking section, and the releasing unit has an operating section provided at a position corresponding to the elastic hooking sections of the plug for elastically deforming the elastic hooking piece in the direction inward into the plug.

14. The buckle according to claim 12, wherein the hooking unit includes an elastic hooking projection formed in the socket and capable of elastically deforming, and a hooking hole formed in the plug and hooked with the elastic hooking projection when the plug is inserted into the socket, the elastic hooking section has a guide wall for elastically deforming the elastic hooking projection in the direction orthogonal to the inserting direction and also inward into the socket with the plug when the plug is inserted into the socket and then elastically restoring the elastic hooking projection to the original form to hook the elastic hooking projection in the hooking hole when the hooking hole reaches the elastic hooking projection, and the releasing unit includes an operating section for elastically deforming the elastic hooking projection of the socket in the direction inward into the socket.

15. The buckle according to claim 12, wherein the hooking unit comprises a pair of elastic holding pieces formed on either one of the socket and the plug, and a held pin formed held by the elastic holding pieces when the plug formed on either remaining one of the socket and the plug is inserted into the socket, and the pair of elastic holding pieces has a guide wall elastically deformed by the held pin in the direction in which the pieces move away from each other when the plug is inserted into the socket and then elastically restoring the original form when the held pin has passed therethrough, and a holding section formed at a position closer to the plug inserting side as compared to the guide wall for elastically holding the held pin.

* * * * *